United States Patent [19]

Tondreault

[11] Patent Number: 5,013,264

[45] Date of Patent: May 7, 1991

[54] EDGE CARD CONNECTOR HAVING PRELOADED CONTACTS

[75] Inventor: Robert J. Tondreault, Louisville, Ky.

[73] Assignee: Robinson Nugent, Inc., New Albany, Ind.

[21] Appl. No.: 411,796

[22] Filed: Sep. 25, 1989

[51] Int. Cl.[5] ..... H01R 13/62

[52] U.S. Cl. ..... 439/636; 439/741

[58] Field of Search ..... 439/629-637, 439/851, 856, 857, 55, 59-62, 741, 871

[56] References Cited

U.S. PATENT DOCUMENTS

| | | | |
|---|---|---|---|
| Re. 26,692 | 10/1969 | Ruchlemann | 439/637 |
| 2,549,725 | 4/1951 | Uline et al. . | |
| 2,762,026 | 9/1956 | Knohl . | |
| 3,015,083 | 12/1961 | Juris . | |
| 3,047,831 | 7/1962 | Majewski . | |
| 3,127,228 | 3/1964 | Greco et al. . | |
| 3,199,066 | 8/1965 | Eledge et al. . | |
| 3,231,785 | 1/1966 | Calabro . | |
| 3,289,146 | 11/1966 | Zuckel | 439/630 |
| 3,524,161 | 8/1970 | Frantz et al. | 439/629 |
| 3,567,998 | 3/1971 | Ammerman . | |
| 3,699,396 | 10/1972 | Colaud et al. . | |
| 3,704,394 | 11/1972 | Johnson . | |
| 3,732,531 | 5/1973 | Bouley . | |
| 3,737,838 | 6/1973 | Mattingly, Jr. et al. . | |
| 3,950,057 | 4/1076 | Calabro . | |
| 4,136,917 | 1/1979 | Thea et al. . | |
| 4,204,737 | 5/1980 | Faber et al. . | |
| 4,221,448 | 9/1980 | Logerot et al. . | |
| 4,223,973 | 9/1980 | Tamburro . | |
| 4,275,944 | 6/1981 | Sochor | 439/636 |
| 4,349,237 | 9/1982 | Cobaugh et al. . | |
| 4,575,172 | 3/1986 | Walse et al. . | |
| 4,607,907 | 8/1986 | Bogursky . | |
| 4,713,013 | 12/1987 | Regnier et al. . | |
| 4,725,250 | 2/1988 | Kuhn, et al. . | |
| 4,737,120 | 4/1988 | Grabbe et al. . | |
| 4,756,694 | 7/1988 | Billman et al. . | |
| 4,781,612 | 11/1988 | Thrush . | |
| 4,795,379 | 1/1989 | Sasaki et al. . | |
| 4,846,734 | 7/1989 | Lytle . | |
| 4,869,672 | 9/1989 | Andrews, Jr. . | |
| 4,973,270 | 11/1990 | Billman, et al. . | |

FOREIGN PATENT DOCUMENTS

| | | | |
|---|---|---|---|
| 0367373 | 5/1990 | European Pat. Off. . | |
| 1640392 | 2/1971 | Fed. Rep. of Germany | 439/637 |
| 1222168 | 6/1960 | France . | |
| 1188045 | 4/1970 | United Kingdom | 439/637 |
| 1192058 | 5/1970 | United Kingdom | 439/637 |

*Primary Examiner*—David L. Pirlot
*Attorney, Agent, or Firm*—Barnes & Thornburg

[57] ABSTRACT

A low insertion force edge card connector having preloaded conductive spring arms that establish an electrical contact between the preloaded spring arms and the edge card. The edge card connector has an insulative housing consisting essentially of a dielectric material, a spring arm coupled to the insulative housing, a contact arm extending from the spring arm, the contact arm having a contact surface to engage the edge card in electrical connection, and a preload tab appended to a junction between the spring arm and the contact arm to engage the insulative housing and establish a preloaded position for the spring arm with respect to the insulative housing.

21 Claims, 4 Drawing Sheets

EDGE CARD CONNECTOR HAVING PRELOADED CONTACTS

BACKGROUND AND SUMMARY OF THE INVENTION

This invention relates to edge card connectors and particularly to low insertion force edge card connectors for use in conjunction with printed circuit boards and edge cards. More particularly, this invention relates to an edge card connector having a plurality of preloaded, low insertion force electrical spring contacts.

Edge cards are a variety of printed circuit board generally designed to be mounted perpendicular with respect to a mother circuit board. Edge cards are often identified as daughter boards because of their relation to the mother boards on which they are mounted. The perpendicular mounting permits flexibility in circuit design, placement of a plurality of edge cards in electrical connection with a single mother circuit board, easy insertion or replacement of the edge card, and ease of fabrication of assemblies of edge cards and the mother circuit board.

Electrical connection between the edge card and the mother circuit board is maintained with the aid of an edge card connector that mechanically holds the edge card in a desired position, and provides an electrically conductive pathway between the edge card and the mother circuit board. Conventional edge card connectors such as disclosed in U.S. Pat. No. 3,530,422 to Goodman have socket-type mechanisms with non-preloaded electrical contacts fitted in a housing into which an edge card can be inserted or removed.

In many cases, insertion of edge cards into a socket type electrical edge connector can be difficult. Socket type edge connectors can include a socket contact having two electrically conductive spring-loaded arms that engage opposite sides of the edge card as it is inserted into the socket contact. These spring arms cooperate to clamp the edge card contact in place and ensure that the electrical connection between the card and the socket is not broken intermittently upon exposure of the assembly of edge card and edge card connector to shock, vibration, or other physical movement. Ordinarily, a significant clamping force must be exerted by the spring arms to provide an uninterrupted electrical contact between the edge card contact and the mating socket contact provided in the edge card connector. It will be understood that other clamping means, in addition to the socket contact, generally is provided in an edge connector for clamping the edge card to its mother board to hold the edge card in a stable position largely unaffected by shock or vibration.

Even though exerting somewhat high clamping forces against the edge card is desirable because the mechanical and electrical connection is maintained better at high clamping forces than at relatively lower clamping forces, it has been observed that high clamping force connections can make insertion of an edge card into a socket contact of an edge card connector difficult, particularly for automated equipment commonly used to insert edge cards into the edge card connector. Manual or automatic insertion that uses higher insertion forces to insert the edge card into the socket contact is not advisable, because of the increased chance of the damage to the edge card or the edge card connector if the edge card is misaligned during insertion.

The problems associated with high insertion forces can be alleviated by providing edge card connectors configured to require only low insertion forces for an edge card. For example, U.S. Pat. No. 3,671,917 to Ammon et al. and U.S. Pat. No. 3,737,838 to Mattingly, Jr. are examples of low insertion force edge card connectors that preload two spring arms that act as electrical contacts. A preload tab is positioned at the terminal end of the spring arms to engage a portion of an insulative housing so that the insertion forces required are diminished.

It is therefore an object of this invention to provide an edge card connector requiring low insertion forces to insert an edge card that is still capable of maintaining a high normal force to engage and clamp an edge card sufficiently to establish an electrical connection between the edge card and the connector.

It is a further object of this invention to provide a low insertion force edge card connector having an insulative housing in which an electrical conductor is configured to form a spring that is preloaded by engagement with the insulative housing to minimize the insertion force and that is displaced by an edge card during insertion to exert a normal force against the contact surface of the edge card to maintain an electrical contact between the edge card and the edge card connector.

Yet another object of this invention is to provide an insertion tool for use in conjunction with a socket contact to assist in installing the socket contact in an insulative housing to form an edge card connector requiring low insertion forces to insert an edge card.

Still another object of the present invention is to provide a tool that is insertable into an insulative housing of an edge card connector to support the insulative housing during insertion of a socket contact into the insullative housing and also to maintain the spring arms of the socket contact in a spread or splayed configuration until preloading tabs on the spring arms engage flanges provided in the insulative housing to lock the spring arms in a preloaded position.

One further object of the invention is an assembly of a socket contact including a spring having a low spring rate compactly fitted into a housing, and having a preload tab extending from a junction between the spring arm and the contact arm.

In accordance with the foregoing objectives, an apparatus for forming a low insertion force connector for edge cards includes an insulative housing having a support mount for supporting an edge card. The support mount has a primary camming surface along which socket contacts can slide as they are inserted into a cavity formed in the insulative housing. Also included in the housing is a preload block or flange situated above and to the left of the support mount. Another component of the apparatus is an insertion tool having an auxiliary camming surface that is aligned with the primary camming surface of the support mount to provide continuous means for camming the spring arms of the socket contact to a spread-apart, preloaded position cocked to engage the preload block upon full insertion of the socket contact into its cavity in the insulative housing.

During emplacement of a socket contact into the insulative housing, each spring arm slidably moves along the camming surfaces of first the support member and subsequently the insertion tool. The socket contact includes a spring arm attached to the housing and a contact arm integrally appended to the distal end of the spring arm. The contact arm contacts the first camming surface during insertion of the socket contact into the insulative housing so that the spring arm is moved outwardly during insertion of the socket contact into the housing, permitting a preload tab, appended to the socket contact at the junction between the spring arm and contact arm to engage the preload block, and thereby maintain the spring arm under springing tension having a force component directed normal to an edge card inserted into the housing so that force is transmitted to the edge card by the contact arm.

In preferred embodiments, the socket contact is configured to form a double armed spring with first and second contact surfaces between which the edge card is clamped by spring forces exerted normal to the surface of the edge card to ensure steady maintenance of electrical contact. Attachment of the socket contact to the support mount on the edge connector housing is enabled by a first and second clamping portion that clamps the socket contact to the support mount in locking engagement. These first and second clamping portions are formed at the proximal end of the two spring arms appended to the solder tail of the socket contact. Barbed catches are formed on the first and second clamping portions to cause the clamping portions to be coupled permanently to the support mount.

The preload tabs are situated at a junction between the proximal end of the contact arms and the distal end of the spring arms. The preload tabs are protruding tabs that extend away from the spring arms to engage preload blocks attached or integrally formed with the insulative housing. Engagement of the tabs and the preload blocks acts to separate the contact arms in spread apart or splayed relation and consequently preload the spring arms, which are maintained under greater springing tension then an equivalent spring lacking preload tabs that is similarly positioned in the housing.

An advantage of preloaded spring arms is the reduced insertion force necessary to insert an edge card into the edge card connector. The contact surfaces of the contact arms are curved to provide a ramping or wedging surface against which an edge card that is being inserted can act against in order to force the spring arm outward from the edge card. If the wedging surface is canted at a high angle relative to the inserted edge card, the static and dynamic frictional forces are quite high, and the component force exerted normal to the edge card to move the contact arm outward is greatly reduced relative to those wedging surfaces positioned nearly parallel to the surface of the inserted edge card. These problems can be greatly reduced by preloading the spring arms so that the spring arm is held under tension in a position that still ensures the application of high normal forces to a fully inserted edge card, yet also presents a contact surface lying nearly parallel to the surface of the edge card as the edge card is inserted into the edge card connector. This positioning greatly reduces the insertion force required to overcome the static and dynamic frictional forces between the edge card and the contact surface, and greatly eases the force required to move the contact arm outward.

Another advantage is provided by constructing the electrical connector with an insertion tool to form an auxiliary camming surface along which the contact surfaces of the contact arms can slide during insertion of the spring arms into the housing. The insertion tool temporarily forms a camming surface in conjunction with the camming surface of the supporting mount and acts to spread the spring arms and thereby guide the preload tabs into their proper working position. Without the insertion tool, the spring arms would not be placed under an outward tension that spreads the contact arms far enough apart and moves the preload tabs into a spread position suitable for engaging the preload blocks. No complex features or guides are required on either the spring arms or the housing to guide the preload tabs into the proper operating position.

Yet another advantage of the present invention is provided by the wiping action of the contact surfaces as the edge card is inserted. In contrast to simple cantilever springs, the serpentine configuration of the the spring arm permits the spring arms to move essentially parallel to the surface of the edge card during insertion. This essentially parallel movement increases the area of the surface of the edge card wiped clean of debris that could reduce the electrical contact between the contact surface of the contact arm and the edge card.

Additional objects, features, and advantages of the invention will become apparent to those skilled in the art on consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
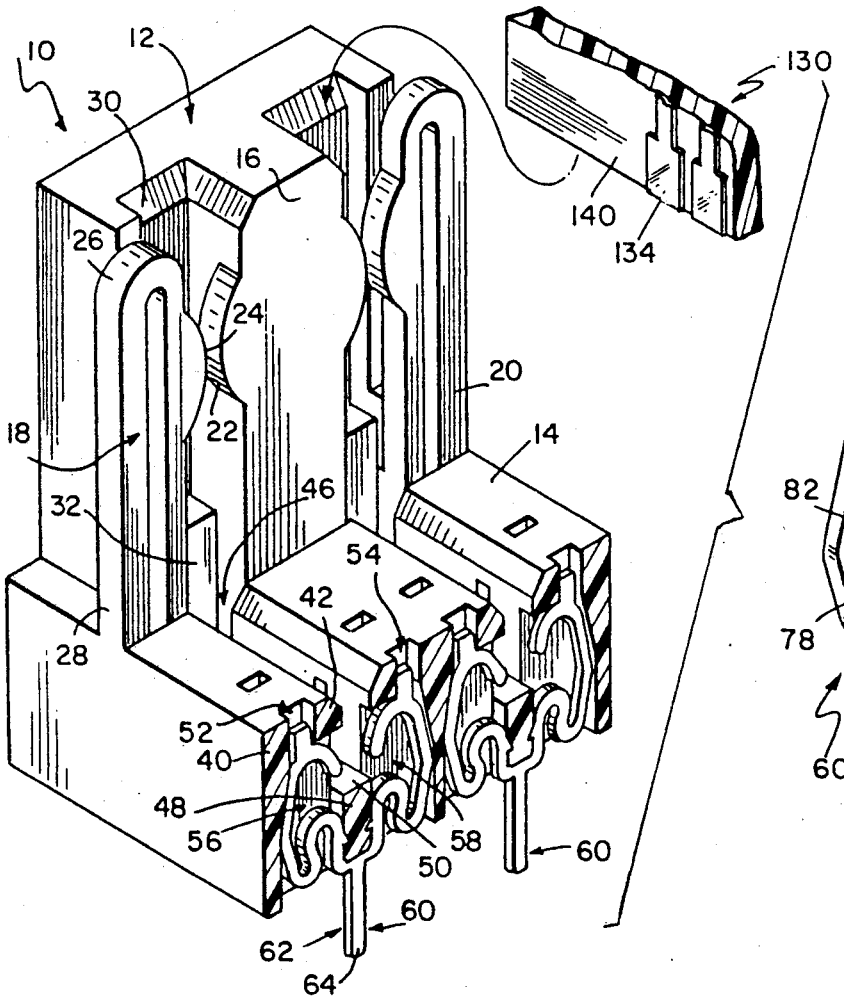
FIG. 1 is a partial perspective view of an edge card connector and an edge card to be inserted therein.
Figure 2:
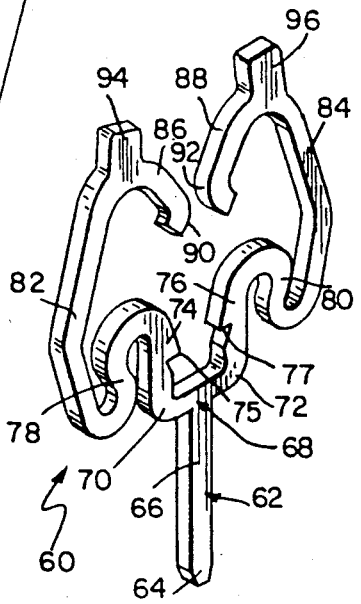
FIG. 2 is a perspective view of a socket contact before insertion into the edge card connector.

Referring to the drawings and initially to FIG. 1, there is illustrated a socket-type low insertion force edge card connector 10 for connecting with an edge card 130 having an upper portion 138 (shown in FIG. 7), a lower portion 140, and a first edge card contact surface 134. The edge card connector 10 is divided into a stabilizing member portion 12 for stabilizing the upper portion 138 of an edge card 130, and an electrical contact portion 14, located below the stabilizing member 12. The electrical contact portion 14 acts to provide a mechanical and electrical contact between the edge card connector 10 and the edge card first contact surface 134.

The upper portion of an edge card is stabilized in a predetermined position by the opposed action of an internal stabilizing beam 16 and an external stabilizing beam 18. External stabilizing beam 18 is movable relative to the fixed internal stabilizing beam 16. The external stabilizing beam has a free end 26 and an attached end 28, with the attached end 28 being connected to the electrical contact portion 14 of the edge card connector 10. The internal stabilizing beam 16 is formed to have an internal convex contact surface 22 positioned to oppose a similarly configured external convex contact surface 24 located on the external stabilizing beam 18.

The external stabilizing beam 18 acts as a cantilevered spring when the free end 26 is moved away from its upright position shown in FIG. 1 by insertion of the edge card between the internal stabilizing beam 16 and the external stabilizing beam 18. A force resulting from the elastic properties of the material forming the external stabilizing beam 18 and directed essentially normal to the surface of the edge card is applied through the external convex contact surface 24 to the left side 134 of the edge card 130. This force is opposed by an equal force directed against a right side 136 situated on the opposite side of the edge card through the internal convex contact surface 22. The edge card 110 is clampingly engaged by these opposing forces, stabilizing the upper portion 138 of the edge card 130 and limiting vibration induced movement of the edge card 130.

Figure 7:
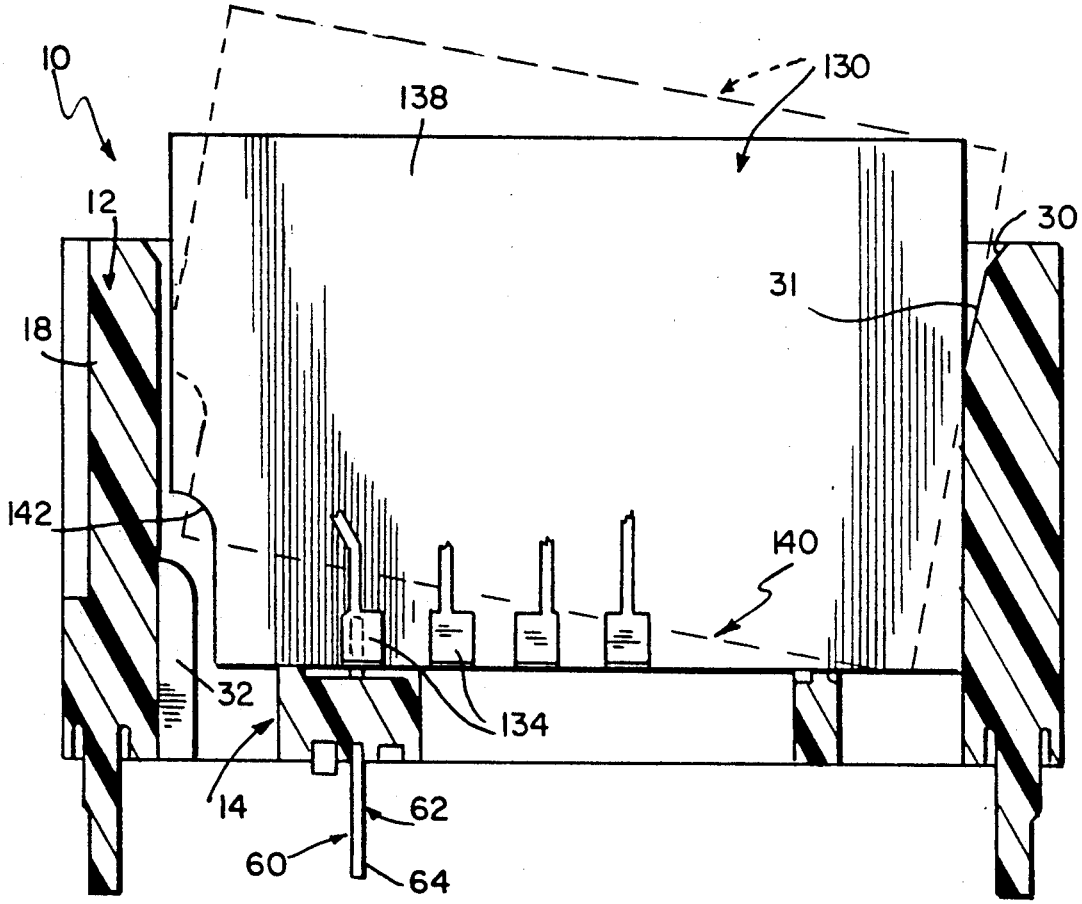
FIG. 7 is side view of an edge card connector illustrating the insertion of an edge card into the stabilizing portion of the edge card connector.

The ready insertion and withdrawal of the edge card 130 into the edge card connector 10 is promoted by several different features of the stabilizing portion 12. As best shown in FIG. 7, which is a side view of the stabilizing portion 12, an edge card 130 can be inserted into the stabilizing portion 12 in a non-perpendicular position because of configuration of the angled edge card insertion surface 30 and an adjacently located extended edge card insertion surface 31. The combination of the the angled edge card insertion surface 30 and the extended edge card insertion surface 31 form a camming surface that guides the edge card 110 to the proper near perpendicular position for insertion into the electrical contact portion 14 of the edge card connector 10.

Another feature optionally present in the stabilizing portion 12 of the edge card connector 10 is a polarizing plug 32, as shown in FIGS. 1 and 7. A polarizing plug 32 prevents the incorrect insertion of an edge card 130 having a polarizing notch 142 into the electrical contact portion 14 of the edge card connector 10. This feature is only present when the edge card 130 has the polarizing notch 142.

Figure 4:
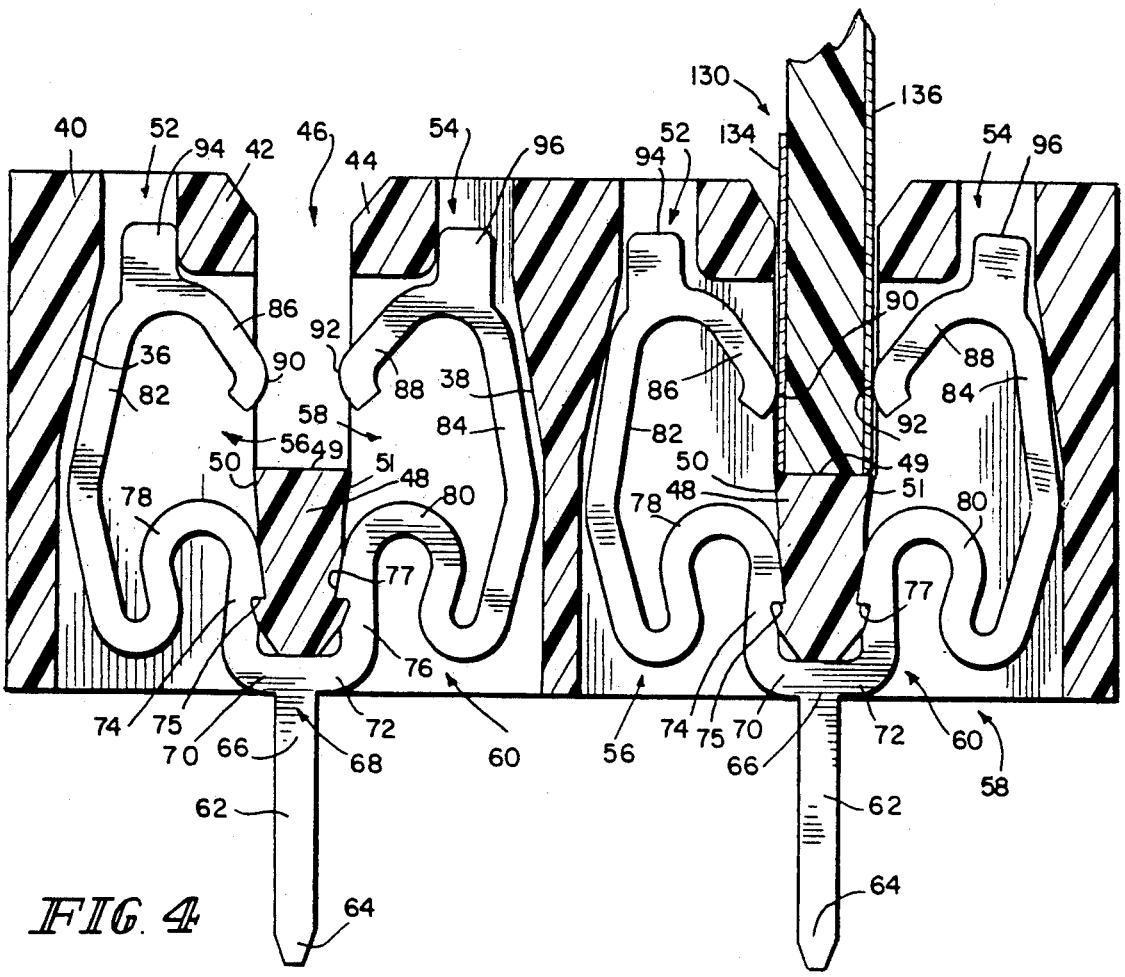
FIG. 4 is side view of the two socket contacts in the insulative housing, with one socket contact clampingly engaging an edge card and a second socket contact sited in a preloaded position with no inserted edge card.

The electrical contact portion 14 as shown in the figures is located below the stabilizing portion 12. The electrical contact portion 14 includes an insulative housing 40 configured to contain a socket contact 60. Preferably, the insulative housing 40 is constructed of a dielectric material such as thermoplastic or other easily moldable materials. As best shown in FIGS. 1 and 4, the insulative housing has a left wall 36, a right wall 38, a left preload block 42, a right preload block 44, and a support mount 44 with an upper support mount surface 48, a left support mount surface 50 and a right support mount surface 51. Both the left preload block 42 and the right preload block 44 are separated from and located above the support mount 48. The left preload block 42, the right preload block 44 and the support mount 48 are all located between the left wall 36 and the right wall 38 of the insulative housing 40. In the embodiment of the invention shown in the figures, the left preload block 42, the right preload block 44, and the support mount 48 are integral to the insulative housing 40.

The left preload block 42 and the right preload block 44 partially define in conjunction with the support mount 48 an insertion cavity 46 located between the left preload block 42 and the right preload block 44 and above the upper support mount surface 49 of the support mount 48. The dimensions of the insertion cavity 46 are such that the edge card 130 can be inserted within the insertion cavity 46 such as shown in FIG. 4, which illustrates the insertion cavity 46 empty and with an edge card.

Also defined within the insulative housing 40 are a left preload cavity 52, a right preload cavity 54, a left spring cavity 56 and a right spring cavity 58. The left preload cavity 52 is defined between the left preload block 42 and the the left wall 36, and the right preload cavity is similarly defined between the right preload block 54 and the right wall 38. The left spring cavity 56 is located below the left preload cavity 52 and is defined in part by the left wall 36 and the left support mount surface 50. The right spring cavity 58 is similarly located below the right preload cavity 54 and is defined in part by the right wall 38 and the right support mount surface 51 of the support mount 48.

Figure 3:
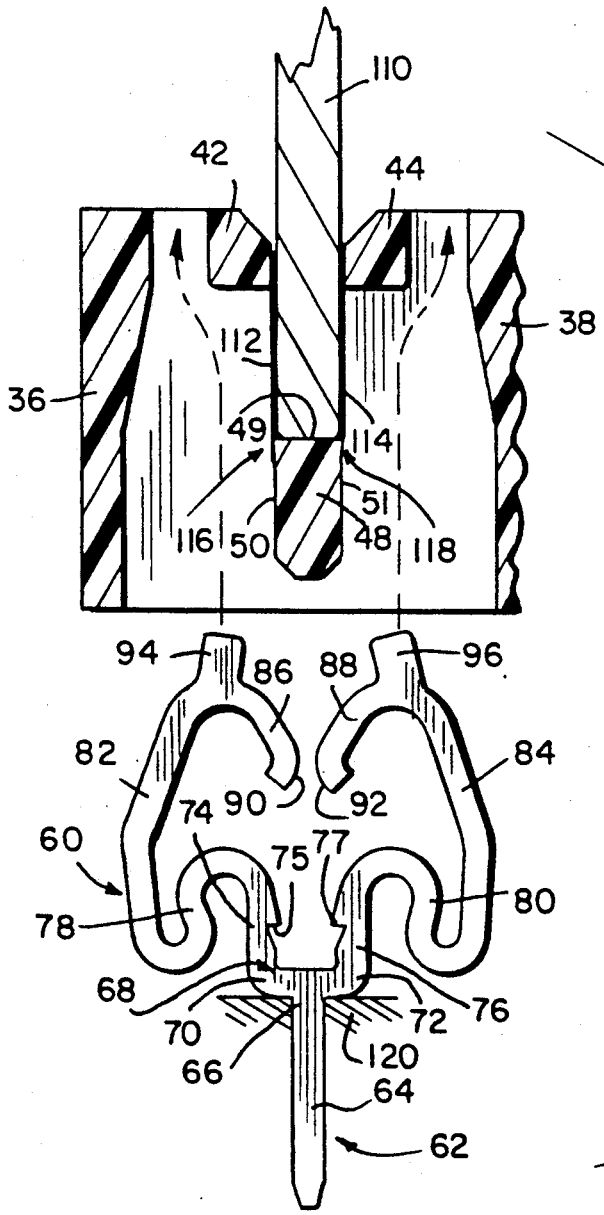
FIG. 3 is a partial side view of the edge card connector shown is FIG. 1, illustrating the path followed by the preload tabs during insertion of the socket contact into an insulative housing of the edge card connector as the contact mating surfaces slide along the continuous camming surface formed by the alignment of the support mount in the insulative housing and an insertion tool temporarily deposited in the insertion cavity.

All of the foregoing cavities in the insulative housing 40 are configured to accomodate a socket contact 60, shaped to be bilaterally symmetric, and best shown in association with the insulative housing 60 in FIG. 4 and alone in FIG. 3. The socket contact can be formed from various electricity conducting materials known to those skilled in the art of electrical conductors, and generally consists of a metal, a conductive alloy, or a metal laminate coated with a highly conductive material such as silver or gold.

The socket contact 60 has a solder tail 62 for contact with a mother board or other electrical contact assembly (not shown). The solder tail 62 has a tail end 64 to be placed in contact with other electrical contact assemblies by soldering or other art-recognized means and a fork end 66 connected to a fork 68. The fork 68 is bifurcated, splitting into a left fork 70 and a right fork 72 that respectively extend to the left and the right of the tail 62. The left fork 70 is connected to a left clamping portion 74, and the right fork 72 is connected to a right clamping portion 76. The left clamping arm 74 and the right clamping portion 76 both curve slightly inward toward each other, and are respectively fitted with a left barb 75 and a right barb 77.

The left clamping portion 74 is connected to a left downward arm 78 that extends downwardly and to the left of the left clamping portion 74. The left downward arm is in turn connected to a left spring arm 82 extending generally parallel to and upward in relation to the left clamping portion 74. The left spring arm 82 terminates by branching to form a left preload tab 94 and a left contact arm 86, with the left preload tab 94 continuing to extend upward. In the embodiment of the invention shown in FIGS. 1–4, the left contact arm extends to the right of the spring arm 82 and is downwardly angled. In the embodiment of the invention shown in FIG. 5 and FIG. 6, a left contact arm **86*a* substantially forms a right angle with respect to the left spring arm 82*a***.

In a similar manner, and forming a mirror image bilaterally symmetric to a longitudinal plane passing through the tail 62, right fork 72 is connected to a right clamping portion 76. The right clamping portion 76 is connected to a right downward arm 80 that extends downwardly and to the right of the right clamping portion 76. The right downward arm is in turn connected to a right spring arm 84 extending generally parallel to and upward in relation to the right clamping portion 76. The right spring arm 84 terminates by branching to form a right preload tab 96 and a right contact arm 88, with the right preload tab 96 continuing to extend upward. In the embodiment of the invention shown in FIGS. 1–4, the right contact arm extends to the left of the spring arm 84 and is downwardly angled. In the embodiment of the invention shown in FIG. 5 and FIG. 6, the right contact arm 88*a* substantially forms a right angle with respect to the right spring arm 84*a*.

To emplace the double spring contact 60 in the insulative housing 40 an insertion tool 110 and a tail holder 120 are required as shown in FIG. 3. The tail holder 120 grasps the tail 62 of the socket contact 60 and positions the socket contact 60 so that the left contact arm 86 is situated below and to the left of the support mount 48 and the right contact arm 88 is situated below and to the right of the support mount 48. The insertion tool 110 has a left surface 112 and a right surface 114 that respectively combine with the left support mount surface 50 and the right support mount surface 51 to respectively form a left camming surface 116 and a right camming surface 118 when the insertion tool 110 is inserted into the insertion cavity 46 to lie in an abutting relationship to the upper support mount surface 49.

When the tail holder 110 moves the double socket contact 60 into the insulative housing 40, the left contact surface 90 and the right contact surface 92 respectively engage the left camming surface 116 and right camming surface 118 to separate the left contact surface 90 from the right contact surface 92. This movement also has the desired effect of positioning the the left preload tab 94 and the right preload tab 96 for insertion respectively into left preload cavity 52 and the right preload cavity 54. Upon removal of the insertion tool 110 from the insulative housing 40, the tension on the left spring arm 82 is somewhat relieved and the left contact surface 88 moves toward the right contact surface 90 until further movement is blocked by the abutting relationship of the left preload tab 94 against the left preload block 42. Similarly, removal of the insertion tool 110 from the insulative housing 40, causes the tension on the right spring to be somewhat relieved, and the right contact surface 90 moves toward the left contact surface 88 until further movement is blocked by the abutting relationship of the right preload tab 96 against the right preload block 44. The final configuration of the socket contact 60 is best illustrated in FIG. 1 and FIG. 4, which show the socket contact 60 in a preloaded condition following removal of the insertion tool 110 from the insulative housing 40. It should be noted that the left contact surface 90*a* and the right contact surface 92 a both slightly protrude into the insertion cavity 46, positioned to impede the insertion of the edge card 130 into that insertion cavity 46.

Figure 5:
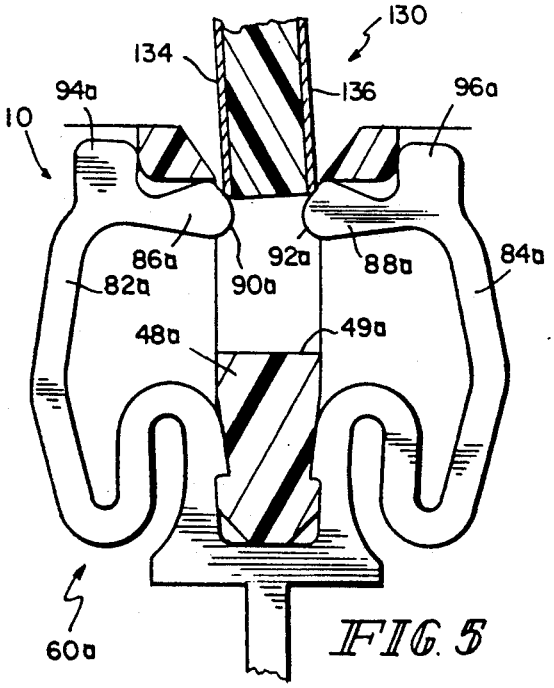
FIG. 5 is an alternative embodiment of the invention, showing a socket contact with contact arms directed substantially parallel to an inserted edge card and into which an edge card is being inserted.
Figure 6:
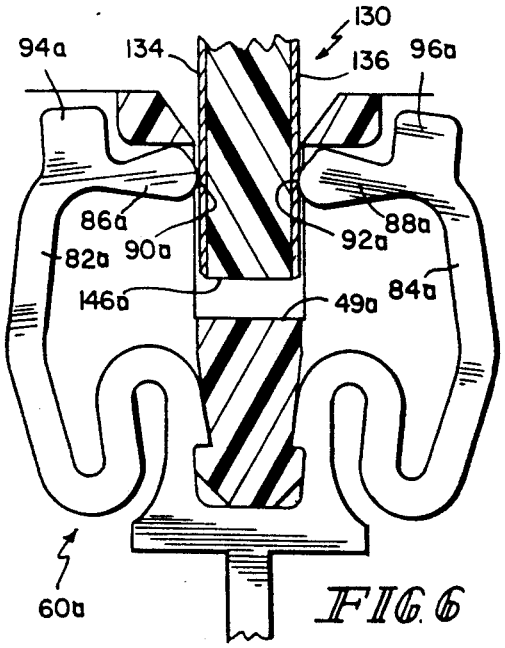
FIG. 6 shows the edge card connector of FIG. 5 with the edge card partially inserted between the spring contact.

Insertion of an edge card into an edge card connector 10 is best shown in FIGS. 5 and 6, which illustrate as an alternative embodiment a socket contact 60*a* having a left contact arm 86*a* and a right contact arm 88*a* that are configured in a substantially perpendicular position to a left spring arm 82*a* and a right spring arm 84*a*. As shown in FIG. 5, as an edge card 130 is inserted into the edge card connector 10, a left contact surface 90*a* and a right contact surface 92*a* present a sloping surface that can be both frictionally and cammingly engaged by the edge card during insertion. The frictional engagement acts to wipe the left and right contact surfaces 90*a* and 92*a* clean of any accumulated debris that could impede electrical contact, and the camming action separates the left and right contact surfaces 90*a* and 92*a* so that the edge card 130 can be inserted. The edge card 130 is further inserted as shown in FIG. 6 until a bottom surface 146*a* contacts the upper support mount surface 49, and the edge card 130 is in its fully inserted state, as best shown in FIG. 4.

Although the invention has been described in detail with reference to a preferred embodiment, variations and modifications exist within the scope and spirit of the invention as described and defined in the following claims.

I claim:

1. A low insertion force edge card connector having electrically conductive spring arms to establish an electrical contact between the preloaded spring arms and the edge card the edge card connector comprising an insulative housing consisting essentially of a dielectric material and having a substantially rigid inflexible portion, a spring arm having a first end coupled to the insulative housing and a second end, a contact arm connected to the second end of the spring arm to define a junction interconnecting the spring arm and the contact arm, the contact arm having an unrestrained end with a contact surface to engage the edge card in electrical connection, and means for engaging the substantially rigid infexible portion of the insulative housing to establish a preloaded position for the spring arm with respect to the insulative housing, the engaging means being appended to the junction interconnecting the spring arm and the contact arm.

2. The apparatus of claim 1, wherein the means for engaging includes a preload tab having a proximal end appended to the junction between the spring arm and the contact arm and a distal end projecting away from the junction and having a surface positioned to engage the insulative housing.

3. The apparatus of claim 2, wherein the spring arm includes a tail, and is bilaterally symmetric about a plane passing through the tail, and includes a left spring arm coupled to a left contact arm and a right spring arm coupled to a right contact arm.

4. A socket contact mountable in an insulative housing to receive an edge card therein to establish an electrical connection with the edge card, the socket contact comprising a body portion having a tail for connection to a mother printed circuit board and first means for engaging the insulative housing to position the body portion in a cavity formed in the insulative housing, a contact arm having a contact mating surface with an unrestrained free end positioned to engage an edge card inserted into the cavity, a spring arm interconnecting the body portion and the contact arm, the spring arm being configured to bias the contact mating surface in a first direction against an edge card inserted into the cavity, and a preloading tab providing second means for engaging a substantially rigid and inflexible portion of the insulative housing to establish a preloaded position of the contact mating surface with respect to the insulative housing, the preloading tab being appended to the contact and spring arms at the junction therebetween.

5. A low insertion force edge card connector for establishing electrical contact with an edge card and a mother board, the connector comprising an insulative housing formed to include an interior cavity and a top opening into the interior cavity, socket means for receiving an edge card extending into the interior cavity through the top opening, the socket means being made out of an electrically conductive material and coupled to the insulative housing to lie in the interior cavity, the socket means including tail means for engaging a mother board and a pair of spring-loaded contact arms arranged in splayed relation, each contact arm being appended to the tail means and terminating in a contact mating surface engaging an edge card deposited into the socket means, and means for spreading the contact mating surfaces apart to a preloaded position to preload the spring-loaded contact arms so that a thrust force sufficient to insert an edge card into the socket means is minimized, the spreading means including a pair of preload tabs, each preload tab being appended to one of the spring-loaded contact arms at a point located between the tail means and the contact mating surface and engaging the insulative housing to establish the preloaded position of the contact mating surfaces.

6. The connector of claim 5, wherein the insulative housing is formed to include a top aperture opening into the interior cavity and a pair of preloaded blocks arranged in spaced-apart relation to define the top opening into the interior cavity therebetween, and each preload tab engages one of the preload blocks to hold its respective contact mating surface in its preloaded position.

7. The connector of claim 6, wherein the insulative housing includes a support mount positioned in the interior cavity to lie in confronting relation to the top aperture and the socket means includes means for clamping the support mount to fix the socket means in the interior cavity, position each of the preload tabs in engagement with one of the preload blocks, and position each of the contact mating surfaces in close proximity to the top aperture to engage an edge card deposited into the interior cavity through the top aperture.

8. The connector of claim 5, wherein the edge card includes a pair of side faces and an end face extending between the side faces, the insulative housing includes platform means in the interior cavity for engaging the end face of the edge card to support the edge card in the interior cavity, and the socket means includes means for clamping the platform means to fix the socket means in the interior cavity and position each of the contact mating surfaces in close proximity to the top aperture to engage an edge card deposited into the interior cavity through the top aperture.

9. The connector of claim 8, wherein the clamping means includes a barb appended to each of the spring-loaded contact arms.

10. A low insertion force edge card connector for establishing electrical contact with an edge card and a mother board, the connector comprising an insulative housing having an interior cavity, socket means for receiving an edge card, the socket means being made of an electrically conductive material and coupled to the insulative housing to lie in a position to receive an edge card inserted into the interior cavity of the insulative housing, the socket means including tail means for engaging the mother board, at least one contact arm with an unrestrained free end arranged to engage an edge card received in the socket means, and a spring arm interconnecting the tail means and each contact arm and biasing each contact arm into engagement with the edge card received in the socket means, each contact arm being movable relative to the insulative housing against a biasing force provided by its companion spring arm sequentially between a relaxed position, a preloaded position, and a loaded position, and a preload tab appended to the socket means at a junction between the spring arm and each contact arm, the preload tab engaging a substantially rigid and inflexible portion of the insulative housing to hold the contact arm in its preloaded position until insertion of an edge card into the socket means, whereby each contact arm is moved relative to the insulative housing to its loaded position by the edge card.

11. The connector of claim 10, wherein the insulative housing is formed to include a top aperture opening into the interior cavity and a support mount positioned in the interior cavity to lie in confronting relation to the top aperture, and the socket means includes means for clamping the support mount to fix the socket means in the interior cavity and position each of the contact arms in close proximity to the top aperture to engage an edge card deposited into the interior cavity through the top aperture.

12. The connector of claim 11, wherein the insulative housing includes at least one preload bock extending into the interior cavity and lying in spaced-apart relation to the support mount, and each preload tab engages the preload block and holds its respective contact arm in its preloaded position.

13. A low insertion force edge card connector for establishing electrical contact with an edge card and a mother board, the connector comprising an insulative housing having an interior cavity, socket means for receiving an edge card, the socket means being made of an electrically conductive material and coupled to the insulative housing to lie in a position to receive an edge card inserted into the interior cavity of the insulative housing, the socket means including tail means for engaging a mother board, at least one contact arm arranged to engage an edge card received in the socket means, and a spring arm interconnecting the tail means and each contact arm and biasing each contact arm into engagement with the edge card received in the socket means, each contact arm being movable relative to the insulative housing against a biasing force provided by its companion spring arm sequentially between a relaxed position, a preloaded position, and a loaded position, a preload tab appended to the socket means at a junction between the spring arm and each contact arm, the preload tab engaging the insulative housing to hold the contact arm in its preloaded position until insertion of an edge card into the socket means, whereby each contact arm is moved relative to the insulative housing to its loaded position by the edge card, wherein the insulative housing is formed to include a top aperture opening into the interior cavity and a support mount positioned in the interior cavity to lie in confronting relation to the top aperture, and the socket means includes means for clamping the support mount to fix the socket means in the interior cavity and position each of the contact arms in close proximity to the top aperture to engage an edge card deposited into the interior cavity through the top aperture, wherein the insulative housing includes at least one preload block extending into the interior cavity and lying in spaced-apart relation to the support mount, and each preload tab engages the preload block and holds its respective contact arm in its preloaded position, wherein the insulative housing includes a pair of preload blocks arranged in spaced-apart relation to define the top aperture therebetween and a pair of side walls situated in spaced-apart relation to define the interior cavity therebetween, the preload blocks and the support mount are situated in the interior cavity to lie between the pair of side walls, a first of the side walls and a first of the preload blocks cooperate to define a left preload cavity in the insulative housing communicating with the interior cavity and containing the preload tab engaging the first of the preload blocks, and a second of the side walls and a second of the preload blocks cooperate to define a right preload cavity in the insulative housing communicating with the interior cavity and containing the preload tab engaging the second of the preload blocks.

14. A low insertion force edge card connector for establishing electrical contact with an edge card and a mother board, the connector comprising an insulative housing having an interior cavity, socket means for receiving an edge card, the socket means being made of an electrically conductive material and coupled to the insulative housing to lie in a position to receive an edge card inserted into the interior cavity of the insulative housing, the socket means including tail means for engaging a mother board, at least one contact arm arranged to engage an edge card received in the socket means, and a spring arm interconnecting the tail means and each contact arm and biasing each contact arm into engagement with the edge card received in the socket means, each contact arm being movable relative to the insulative housing against a biasing force provided by its companion spring arm sequentially between a relaxed position, a preloaded position, and a loaded position, a preload tab appended to the socket means at a junction between the spring arm and each contact arm, the preload tab engaging the insulative housing to hold the contact arm in its preloaded position until insertion of an edge card into the socket means, whereby each contact arm is moved relative to the insulative housing to its loaded position by the edge card, wherein the insulative housing is formed to include a top aperture opening into the interior cavity and a support mount positioned in the interior cavity to lie in confronting relation to the top aperture, and the socket means includes means for clamping the support mount to fix the socket means in the interior cavity and position each of the contact arms in close proximity to the top aperture to engage an edge card deposited into the interior cavity through the top aperture, wherein the socket means includes a pair of spring arms appended to the tail means to lie in splayed relation and a pair of contact arms, each contact arm is appended to one of the spring arms to position distal ends of the contact arms in spaced-apart relation to one another in a position in the interior cavity lying in close proximity to the top aperture, and the insulative housing included means for engaging the preload tabs appended to the junction between each spring arm and its companion contact arm in spaced-apart relation to apply a predetermined biasing load to each of the spring arms and hold each of contact arms in its preloaded position to establish a space between the distal ends of the preloaded contact arms into which an edge card is thrust during insertion of an edge card into the socket means.

15. The connector of claim 14, wherein the engaging means includes a pair of preload blocks coupled to the insulative housing and arranged to lie in spaced-apart relation to define the top aperture therebetween, and the preload tab appended to one of the spring arms engages a first of the preload blocks and the preload tab appended to another of the spring arms engages a second of the preload blocks to spread the contact arms against the biasing force provided by the spring arms to assume their preloaded positions.

16. The connector of claim 14, wherein each spring arms includes a serpentine portion coupled to the tail means and an integral, substantially straight portion terminating at the junction of the spring arm, contact arm, and preload tab, and each contact arm includes a substantially straight portion oriented to lie at an acute angle to the straight portion of the spring arm so that the contact arm lies at an angle with respect to an edge card received in the socket means.

17. The connector of claim 14, wherein each spring arm includes a serpentine portion coupled to the tail means and an integral, substantially straight portion terminating at the junction of the spring arm, contact arm, and preload tab and each contact arm includes a substantially straight portion oriented to lie at a right angle to the straight portion of the spring arm so that the contact arm lies in perpendicular relation to an edge card received in the socket means.

18. A low insertion force edge card connector for establishing electrical contact with an edge card and a mother board, the edge card including a pair of side faces and an end face extending between the side faces, the connector comprising an insulative housing formed to include an interior cavity and a top aperture into the interior cavity for receiving an edge card therethrough, the insulative housing including platform means in the interior cavity for engaging the end face of the edge card to support the edge card in the interior cavity, and socket means for receiving an edge card extending into the interior cavity through the top aperture, the socket means including arm means for establishing electrical contact with the side faces of the edge card, means attached to the socket means and a rigid portion of the housing limiting the engagement force of the arm means with the side faces of the edge card and means for clamping the socket means to the platform means to fix the socket means in the interior cavity and position the arm means in close proximity to the top aperture to engage the side faces of an edge card extending into the interior cavity through the top aperture.

19. The connector of claim 18, wherein the socket means includes a tail, the arm means includes a pair of spring arms appended to the tail and arranged to lie in splayed relation and a contact arm appended to each of the spring arms and configured to include a contact mating surface situated to engage one of the side faces of an edge card received in the socket means, and a preload tab appended to each contact arm to lie intermediate the companion spring arm and contact mating surface, the contact arms are movable away from one another against a biasing force provided by the spring arms in sequence from a normal relaxed position first to a preloaded position and second to a loaded position, and the insulative housing includes means for engaging the preload tabs to hold the contact arms in their preloaded position until an edge card is inserted into the socket means to move the contact arms away from one another to assume their loaded position.

20. The connector of claim 18, wherein the socket means includes a tail, the arm means includes a pair of spring arms appended to the tail and arranged to lie in splayed relation and a contact arm appended to each of the spring arms, each contact arm is configured to include a contact mating surface situated to engage one of the side faces of an edge card received in the socket means, and the spring arms are barbed to define the clamping means.

21. The connector of claim 20, wherein each spring arm includes a serpentine-shaped portion and a straight portion, each serpentine-shaped portion applies a biasing force to its companion straight portion to bias the contact mating surface of said companion contact arm into engagement with one side face of an edge card received in the socket means, and each serpentine-shaped portion includes a barb in clamping engagement with the platform means.

* * * * *